US009290722B2

(12) United States Patent
Gutowski et al.

(10) Patent No.: US 9,290,722 B2
(45) **Date of Patent: *Mar. 22, 2016**

(54) CLEANING COMPOSITION FOR DISHWASHING

(71) Applicant: BASF SE, Ludwigshafen (DE)

(72) Inventors: Keith E. Gutowski, Royal Oak, MI (US); Patricia Harris, Woodhaven, MI (US)

(73) Assignee: BASF SE, Ludwigshafen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/861,440

(22) Filed: Apr. 12, 2013

(65) Prior Publication Data

US 2013/0274167 A1 Oct. 17, 2013

Related U.S. Application Data

(60) Provisional application No. 61/623,209, filed on Apr. 12, 2012.

(51) Int. Cl.

| | |
|---|---|
| ***C11D 1/66*** | (2006.01) |
| ***C11D 1/72*** | (2006.01) |
| ***C11D 3/20*** | (2006.01) |
| ***C11D 3/30*** | (2006.01) |
| ***C11D 3/34*** | (2006.01) |
| ***C11D 3/10*** | (2006.01) |
| ***C11D 1/00*** | (2006.01) |
| ***C11D 3/37*** | (2006.01) |
| ***C11D 3/08*** | (2006.01) |
| ***C11D 3/33*** | (2006.01) |

(52) U.S. Cl.

CPC ..... *C11D 3/3472* (2013.01); *C11D 1/00* (2013.01); *C11D 1/72* (2013.01); *C11D 3/08* (2013.01); *C11D 3/10* (2013.01); *C11D 3/30* (2013.01); *C11D 3/33* (2013.01); *C11D 3/34* (2013.01); *C11D 3/3409* (2013.01); *C11D 3/3757* (2013.01)

(58) Field of Classification Search

CPC ..... C11D 1/00; C11D 1/72; C11D 3/08; C11D 3/10; C11D 3/30; C11D 3/33; C11D 3/34; C11D 3/3757

USPC ..... 510/223, 224, 229, 230, 480, 499, 509, 510/511, 421

See application file for complete search history.

(56) References Cited

U.S. PATENT DOCUMENTS

| | | | | |
|---|---|---|---|---|
| 3,563,901 | A | 2/1971 | Crotty | |
| 4,443,270 | A | 4/1984 | Biard et al. | |
| 5,756,443 | A * | 5/1998 | Inoue et al. | 510/238 |
| 5,965,514 | A | 10/1999 | Wierenga et al. | |
| 6,034,257 | A | 3/2000 | Oftring et al. | |
| 6,172,036 | B1 | 1/2001 | Cruickshank et al. | |
| 7,501,027 | B2 * | 3/2009 | Ahmed et al. | 134/42 |
| 7,887,641 | B2 * | 2/2011 | Man et al. | 134/27 |
| 8,193,139 | B2 * | 6/2012 | Seebeck et al. | 510/220 |
| 2004/0194810 | A1 * | 10/2004 | Strothoff et al. | 134/25.2 |
| 2006/0118141 | A1 * | 6/2006 | Andriola et al. | 134/42 |
| 2007/0034606 | A1 | 2/2007 | Dietsche et al. | |
| 2008/0015134 | A1 * | 1/2008 | Ahmed et al. | 510/234 |
| 2008/0199714 | A1 | 8/2008 | Witteler et al. | |
| 2010/0224221 | A1 | 9/2010 | Neplenbroek et al. | |
| 2010/0227179 | A1 | 9/2010 | Pfeiffer et al. | |
| 2010/0240562 | A1 | 9/2010 | Herdt et al. | |
| 2010/0273015 | A1 | 10/2010 | Pfeiffer et al. | |
| 2010/0323943 | A1 * | 12/2010 | Evers et al. | 510/236 |
| 2011/0143987 | A1 * | 6/2011 | Brooker et al. | 510/224 |
| 2011/0160112 | A1 | 6/2011 | Chang et al. | |
| 2011/0237481 | A1 * | 9/2011 | Vinson et al. | 510/197 |
| 2011/0259367 | A1 * | 10/2011 | Ahmed et al. | 134/10 |
| 2012/0279711 | A1 | 11/2012 | Collins et al. | |
| 2012/0291815 | A1 * | 11/2012 | Monsrud et al. | 134/25.2 |

FOREIGN PATENT DOCUMENTS

| | | | |
|---|---|---|---|
| FR | 1419662 | A | 12/1965 |
| GB | 1076979 | A | 7/1967 |
| WO | WO 2010/045686 | A1 | 4/2010 |
| WO | WO 2012/142396 | A1 | 10/2012 |

OTHER PUBLICATIONS

English language abstract not available for FR 1419662; however, see English equivalent GB 1076979, Original document extracted from the espacenet.com database on Jul. 18, 2013, 25 pages.

International Search Report for Application No. PCT/US2013/036323 dated Jul. 8, 2013, 4 pages.

* cited by examiner

*Primary Examiner* — Gregory R Delcotto

(74) *Attorney, Agent, or Firm* — Howard & Howard Attorneys PLLC

(57) ABSTRACT

A cleaning composition comprises the reaction product of A) a chelating component and B) an acidic component different from the chelating component. The chelating component is selected from the group of methylglycine-N—N-diacetic acid (MGDA), N,N-bis(carboxymethyl)-L-glutamate (GLDA), nitrilotriacetic acid (NTA), hydroxyethylethylenediaminetriacetic acid (HEDTA), ethylenediaminetetraacetic acid (EDTA), diethylenetriaminepentaacetic acid (DTPA), and mixtures thereof. The chelating component is generally a salt or a partial-salt of the respective acid, e.g. $Na_3$.MGDA. The B) acidic component and the A) chelating component are reacted in a molar ratio (B:A) of from about 6:1 to about 1:6 to form the reaction product. The cleaning composition further comprises a surfactant component in addition to the reaction product. The cleaning composition is useful for removing and/or preventing spotting and filming on ware surfaces in a dishwater, such as for removing and/or preventing filming and/or spotting on cookware, bakeware, tableware, dishware, flatware, and/or glassware in an automatic dishwasher (ADW).

12 Claims, No Drawings

CLEANING COMPOSITION FOR DISHWASHING

CROSS REFERENCE TO RELATED APPLICATIONS

This application claims the benefit of U.S. Provisional Patent Application Ser. No. 61/623,209 filed on Apr. 12, 2012, which is incorporated herewith by reference in its entirety.

FIELD OF THE INVENTION

The present invention generally relates to a cleaning composition, and more specifically to a cleaning composition for dishwashing with the cleaning composition comprising a surfactant component and the reaction product of a chelating component and an acidic component different from the chelating component.

DESCRIPTION OF THE RELATED ART

Oily and greasy films are difficult to remove in warewash applications. In the past, cleaning compositions that were the most efficacious in removing these types of soils included phosphate-containing components. These cleaning compositions were classified in the art as "high-performance" and usually included trisodium phosphate and sodium tripolyphosphate (STPP). In 2010, a phosphate ban for dishwasher detergents went into effect due to environmental concerns associated with the use of phosphate-containing components. Since the ban, there has been a gap in performance of cleaning compositions. Specifically, phosphate-free cleaning compositions generally fail to match cleaning performance of their phosphate-containing predecessors. As such, rinse aids (or rinse agents) are often used along with detergent compositions in an effort to increase cleaning performance during dishwashing cycles.

However, in many instances, the rinse aid is not able to completely fill in the aforementioned performance gap. Specifically, hardness minerals and hardness mineral/food soil combinations still tend to leave insoluble spots and/or films on dishware, glassware and tableware, and do not allow for maximum cleaning to take place. Spotting is especially a concern with glassware, such as drinking glasses, since spotting is aesthetically displeasing, and calls into question cleanliness of the glassware. Filming, or "milkiness", of glassware poses similar problems. In view of the foregoing, there remains an opportunity to provide improved cleaning compositions for dishwashing.

SUMMARY OF THE INVENTION AND ADVANTAGES

The present invention provides a cleaning composition which is useful for dishwashing. The cleaning composition comprises (I) the reaction product of A) a chelating component and B) an acidic component different from the A) chelating component. The A) chelating component is selected from the group of a1) methylglycine-N—N-diacetic acid (MGDA) and/or a salt thereof, a2) N,N-bis(carboxymethyl)-L-glutamate (GLDA) and/or a salt thereof, a3) nitrilotriacetic acid (NTA) and/or a salt thereof, a4) hydroxyethylethylenediaminetriacetic acid (HEDTA) and/or a salt thereof, a5) ethylenediaminetetraacetic acid (EDTA) and/or a salt thereof, a6) diethylenetriaminepentaacetic acid (DTPA) and/or a salt thereof, and a7) mixtures thereof. The B) acidic component and the A) chelating component are reacted in a molar ratio (B:A) of from about 6:1 to about 1:6 to form the reaction product. The cleaning composition further comprises (II) a surfactant component in addition to the reaction product (I).

The cleaning composition provides excellent prevention and/or removal of films and/or spots on ware surfaces, e.g. dishware, flatware, and glassware. The cleaning composition may be used for dishwasher applications such as automatic dishwasher (ADW) applications. The cleaning composition may be used in and/or as a dishwashing rinse aid and/or a detergent. The cleaning composition is also useful for preventing and/or removing scale from a dishwasher and/or component of the dishwasher.

DETAILED DESCRIPTION OF THE INVENTION

The present invention provides a cleaning composition. While the cleaning composition can be used for various applications, the cleaning composition is especially useful for removing and/or preventing spotting and/or filming on ware surfaces. As such, the cleaning composition may be referred to in the art as a rinse aid. The cleaning composition is also useful for scale inhibition, such as for inhibiting the formation of carbonate scale. The cleaning composition can be used on a variety of different ware surfaces. Examples of such ware surfaces include those found with cookware, bakeware, tableware, dishware, flatware, and glassware. The cleaning composition is not limited to any particular soil or ware surface.

The cleaning composition can be in various forms, such as a liquid, powder, granular, paste, etc. In certain embodiments, the cleaning composition is in the form of a liquid. Water and/or another conventional solvent or carrier can be added or removed to change the form of the cleaning composition. For example, the cleaning composition can be dehydrated to form a powder or granular. The cleaning composition can be in various forms and provided in various fashions, such as by pouch, sachet, or in free form.

The cleaning composition has been found to be useful in dishwashing applications, especially in automatic dishwasher (ADW) applications. The invention cleaning composition can be used alone, or in combination with one or more additional compositions, such as with a conventional detergent composition. Rinse aids generally promote rinsing or rinse water sheeting in a rinsing stage of a wash cycle. While ADW applications are described above, the cleaning composition is not limited to any particular use.

The cleaning composition comprises (I) the reaction product of a chelating component and an acidic component different from the chelating component. The reaction product may also be referred to in the art as a complex or a salt. The reaction product can be formed beforehand or in situ, typically beforehand. The cleaning composition further comprises (II) a surfactant component, and may include one or more additional components, as described further below. In various embodiments, the cleaning composition consists essentially of the reaction product and surfactant component; and in further embodiments consists of the reaction product and surfactant component.

The chelating component may comprise one or more chelating agents, such as an aminocarboxylate. The chelating agent may also be referred to in the art as a complexing agent. The chelating component is useful for inactivating hardness minerals and/or metallic ions, e.g. $Ca^{2+}$ and $Mg^{2+}$. Typically, the chelating agent will combine with hardness minerals and hold them in solution such that the hardness minerals cannot redeposit. The chelating component also provides some detergency boosting.

In certain embodiments, the chelating component comprises methylglycine-N—N-diacetic acid (MGDA) and/or a salt thereof. In various embodiments, the chelating component comprises a salt of or a partial-salt of MGDA, more typically an alkali salt (or partial salt) thereof, e.g. methylglycine diacetate, trisodium salt ($Na_3$.MGDA). In this form, the MGDA may be referred to in the art as a conjugate base. MGDA is also commonly referred to in the art as methylglycine diacetate. As used herein, the alkali salt may include any alkali or alkaline earth metal and is not particularly limited. By "partial-salt", it is generally meant that one or more acidic groups of the chelating component is free.

In other embodiments, the chelating component comprises at least one of N,N-bis(carboxymethyl)-L-glutamate (GLDA), nitrilotriacetic acid (NTA), hydroxyethylethylenediaminetriacetic acid (HEDTA), ethylenediaminetetraacetic acid (EDTA), diethylenetriaminepentaacetic acid (DTPA), and/or a salt or partial-salt thereof, more typically the alkali salt (or partial-salt) thereof, of any of the proceeding chelating agents. In certain embodiments, the chelating component comprises GLDA, which may also be referred to in the art as glutamic acid diacetic acid. The chelating component can comprise a combination or mixture of two or more of the chelating agents, e.g. MGDA and GLDA. The acronyms used herein, e.g. MGDA, can refer to either the acid/acidic, partial-salt, or (full) salt/salted form, e.g. $Na_3$.MGDA, of the respective chelating agent.

Typically, the chelating component is aqueous, such that the chelating component also includes water in addition to the chelating agent. In various embodiments, the chelating component is aqueous and such that the chelating agent, e.g. MGDA, is present in the chelating component in amounts of from about 35 to about 95, from about 35 to about 85, or from about 35 to about 45, or about 40, parts by weight, each based on 100 parts by weight of the chelating component, or any range between the lowest and highest of these values. The chelating component may also be in the form of a powder, granular, or a gel, such that the chelating agent is the chelating component.

Non-limiting examples of suitable chelating components are commercially available from BASF Corporation of Florham Park, N.J., under the trade name TRILON®, such as TRILON® M, TRILON® A, TRILON® B, TRILON® C, and TRILON® D. Further non-limiting examples of suitable chelating components are commercially available from AkzoNobel of Chicago, Ill., under the trade name DISSOLVINE® GL, such as DISSOLVINE® GL 47 S.

Typically, the acidic component is selected from the group of an organic acid, an inorganic acid, and a combination thereof. Examples of suitable organic acids include straight chain or branched carboxylic acids including, but not limited to, lactic acid, acetic acid, formic acid, ascorbic acid, oxalic acid, hydroxymaleic acid, methanesulphonic acid, mandelic acid, glycolic acid, salicylic acid, a pyranosidyl acid such as glucuronic acid or galacturonic acid, citric acid, tartaric acid, pamoic acid, alginic acid, gentisic acid, lactobionic acid, succinic acid, polymers of maleic acid and acrylic acid, and copolymers thereof. Examples of suitable inorganic acids include hydrochloric acid, hypochlorous and chlorous acid, sulfuric acid, sulphurous acid, nitric acid, phosphoric acid, amidosulfonic/sulfamic acid, and phosphorous acid.

More typically, the acidic component comprises an organic sulfonic acid, such as an alkanesulfonic acid. The alkanesulfonic acid can be a short chain alkanesulfonic acid, such as one containing from 1 to 4 carbon atoms (e.g. one having propyl, ethyl, or methyl moieties). In various embodiments, the alkanesulfonic acid is methanesulfonic acid (MSA). MSA is a strong organic acid that is completely non-oxidizing and thermally stable that forms highly soluble salts. Suitable grades of MSA are commercially available from BASF Corporation under the trade name LUTROPUR®, such as LUTROPUR® MSA.

In certain embodiments, the MSA is one which is formed by an air oxidation process, rather than from a chlorooxidation process. As such, the MSA has less metal content, such as less than 1 mg/kg, and little to no chloro compounds, which are generally corrosive. Other non-limiting examples of suitable acidic components are described in U.S. Pat. No. 6,531,629 to Eiermann et al. and in U.S. Pat. App. Pub. No. 2008/0161591 to Richards, the disclosures of which are incorporated herein by reference in their entirety to the extent that the disclosures do not conflict with the general scope of the present invention described herein.

To form the reaction product, the B) acidic component and the A) chelating component are reacted in a molar ratio (B:A) of from about 6:1 to about 1:6, about 5:1 to about 1:5, about 4:1 to about 1:4, about 3:1 to about 1:3, about 2:1 to about 1:2, about 6:1 to about 1:1, about 5:1 to about 1:1, about 4:1 to about 1:1, about 3:1 to about 1:1, about 2:1 to about 1:1, or about 1:1, or any range between the lowest and highest of these values.

Generally, the molar ratio will depend on the number of reactive groups on the chelating component. For example, MGDA has three carboxyl groups which can react with the acidic component (whereas GLDA has four). As such, one, two, or all three of these groups can be reacted with the acidic component, e.g. MSA. The MSA also protonates the amine group of the MGDA, and it is believed that this amine group is preferred over the carboxyl groups, i.e., it is preferentially protonated prior to any of the carboxyl groups. An excess of either component will just impart an unreacted amount of that component in the cleaning composition, such as free MSA. Such an excess can be used to shift pH of the cleaning composition and/or impart additional properties to the cleaning composition. It is believed that in certain embodiments, using a molar excess of the acidic component may cause undesirable precipitation of the chelating component (in a fully neutral form, e.g. crystals may form and settle out over time). As such, the molar ratio of these two components can be adjusted to account for the degree of reaction between the two.

Without being bound or limited by any particular theory, it is believed that in embodiments using MGDA and MSA, a synergy exists between the MGDA and MSA. Specifically, it was discovered that the combination of MGDA (e.g. $Na_3$.MGDA) and MSA has a surprising improvement in preventing spotting and filming than either component alone. It is believed that this unique property is a result of the ability of MSA to dissolve insoluble metal complexes, releasing metal ions where they are captured by the MGDA forming soluble salts. MGDA has a greater affinity for the soluble metal ions than MSA thus freeing the MSA to dissolve additional insoluble metal complexes until both molecules become saturated.

The reaction product can be used in various amounts. Typically, the reaction product is present in the cleaning composition in an amount of from about 0.1 to about 10, about 0.1 to about 5, or about 0.5 to about 2.5, wt. %, each based on 100 parts by weight of the cleaning composition, or any range between the lowest and highest of these values.

The surfactant component assists in dissolving and/or emulsifying certain types of soils. The surfactant component is also useful for surface wetting which helps deliver the cleaning composition to the ware surface. If utilized, the surfactant component is typically selected from the group of nonionic surfactants, anionic surfactants, amphoteric surfactants, cationic surfactants, and ionic surfactants. It is to be appreciated that other types of surfactants can also be used. In certain embodiments, the surfactant component comprises a nonionic surfactant.

Nonionic surfactants, suitable for use with the cleaning composition, include block copolymers such as polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants. Suitable surfactants of this type are synthetic organic polyoxypropylene (PO)-polyoxyethylene (EO) block copolymers. These surfactants generally comprise a di-block polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. The surfactant may also include butylene oxide (BO) blocks, and can include random incorporations of two or three alkylene oxides, e.g. EO/PO/BO, EO/PO/PO, EO/EO/PO, etc. Such surfactants may be referred to in the art as "heteric" block surfactants.

In certain embodiments, the surfactant component comprises an ethylene oxide-propylene oxide (EO/PO) block copolymer and/or a reverse EO/PO block copolymer, i.e., a PO/EO block copolymer. Specific examples of suitable block copolymers include: straight block polymeric glycols obtained, for example, by the addition of ethylene oxide (EO) on a condensation product of propylene oxide (PO) with propylene glycol; and reverse block copolymers obtained, for example, by adding ethylene oxide to ethylene glycol to provide a hydrophile of designated molecular weight, and adding polypropylene oxide to obtain hydrophobic blocks on the outside of the molecule.

Reversing the hydrophobic and hydrophilic blocks of the copolymer PO/EO/PO creates surfactants similar to the regular EO/PO/EO block copolymers, but with some notable differences. Without being limited by any particular theory, it is believed that while the EO/PO/EO straight block copolymers tend to be better emulsifiers and dispersants and cover a broader range of molecular weights, the reverse block copolymers (i.e., PO/EO/PO block copolymers) have lower foaming, greater defoaming, and reduced gelling tendencies. Additionally, reverse block copolymers are typically terminated by secondary hydroxyl groups, which have lower reactivity and acidity than the primary hydroxyl groups which generally terminate EO/PO/EO straight block copolymers. These block copolymers may also be referred to in the art as polaxamers or triblock copolymers.

Additional nonionic surfactants, suitable for purposes of the present invention, include alcohol alkoxylates. Suitable alcohol alkoxylates include linear alcohol ethoxylates. Additional alcohol alkoxylates include alkylphenol ethoxylates, branched alcohol ethoxylates, secondary alcohol ethoxylates, castor oil ethoxylates, alkylamine ethoxylates (also known as alkoxylated alkyl amines), tallow amine ethoxylates, fatty acid ethoxylates, sorbital oleate ethoxylates, end-capped ethoxylates, or combinations thereof. Further nonionic surfactants include amides such as fatty alkanolamides, alkyldiethanolamides, coconut diethanolamide, lauramide diethanolamide, cocoamide diethanolamide, polyethylene glycol cocoamide, oleic diethanolamide, or combinations thereof. Yet further nonionic surfactants include polyalkoxylated aliphatic base, polyalkoxylated amide, glycol esters, glycerol esters, amine oxides, phosphate esters, alcohol phosphate, fatty triglycerides, fatty triglyceride esters, alkyl ether phosphate, alkyl esters, alkyl phenol ethoxylate phosphate esters, alkyl polysaccharides, block copolymers, alkyl polyglucocides, or combinations thereof.

Non-limiting examples of suitable surfactant components are commercially available from BASF Corporation, under the trade name LUTENSOL®, such as LUTENSOL® XP 80, LUTENSOL® TO 8, and LUTENSOL® GD 70; under the trade name TETRONIC®, such as TETRONIC® 304; under the trade name of PLURONIC®, such as PLURONIC® 25R2, PLURONIC® 17R2, and PLURONIC® 25R4; under the trade name DEHYPON®, such as DEHYPON® LS-36 and DEHYPON® LS-54; under the trade name PLURAFAC®, such as PLURAFAC® LF 900, PLURAFAC® SLF 180, PLURAFAC® RA-40, and PLURAFAC® LF 711; as well as under the trade name LUTENSIT®, such as LUTENSIT® AS 2230. Further non-limiting examples are commercially available from Huntsman, under the trade names of EMPILAN®, such EMPILAN® KB and EMPILAN® KC; SURFONIC® L12; TERIC® 12A; and ECOTERIC®, such as ECOTERIC® B30 and ECOTERIC® B35. Further non-limiting examples are commercially available from Croda, under the trade name of NatSurf™, such as NatSurf™ 265. Further non-limiting examples are commercially available from Stepan, under the trade name of BIO-SOFT®, including the BIO-SOFT® N1, N23, and N91 series. Yet further non-limiting examples are commercially available from Air Products, under the trade names of NONIDET® and TOMADOL®. Combinations of two or more different surfactants may be used.

The surfactant component can be used in various amounts. In certain embodiments, the surfactant component is present in the cleaning composition in an amount of from about 1 to about 50, about 10 to about 40, or about 20 to about 30, wt. %, each based on 100 parts by weight of the cleaning composition, or any range between the lowest and highest of these values. Typically, the amounts described herein are based on the assumption that the component includes 100% actives. As such, if the component is aqueous, the amounts can be adjusted accordingly to compensate for % actives dilution.

In certain embodiments, the cleaning composition further comprises a hydrotrope component. In various embodiments, the cleaning composition consists essentially of the reaction product, surfactant component, and hydrotrope component; and in further embodiments consists of the reaction product, surfactant component, and hydrotrope component. The hydrotrope component is useful for increasing stability of the cleaning composition, which also relates to cloud point (or compatibility index) of the cleaning composition. If utilized, various types of hydrotropes can be included in the cleaning composition. Examples of suitable hydrotropes include sulfonates, such as xylene sulfonates, cumene sulfonates, and dihexyl sodium sulfonate; alkyl sulfates such as sodium octyl sulfate; urea; isopropanol and other alcohols; alcohol alkoxylates; glycols such as hexylene glycol and propylene glycol; and those described in U.S. Pat. No. 3,563,901 and U.S. Pat. No. 4,443,270, which are incorporated by reference herein. Non-limiting examples of suitable hydrotrope components are commercially available from BASF Corporation, under the trade name TEXAPON®, such as TEXAPON® 842.

If utilized, the hydrotrope component can be used in various amounts. In certain embodiments, the hydrotrope component is present in the cleaning composition in an amount of from about 0.1 to about 25, about 0.1 to about 15, about 0.1 to about 10, or about 0.1 to about 5, wt. %, each based on 100 parts by weight of the cleaning composition, or any range between the lowest and highest of these values.

In certain embodiments, the cleaning composition further comprises a polymer component. The polymer component may be referred to in the art as a dispersant and/or antiscalent. In certain embodiments, the polymer component is useful for keeping particles of soil that have been removed from wares in a dispersed or suspended state such that the particles are more readily removed from the dishwasher when the wash water is pumped out. The polymer component can also boost cleaning.

In various embodiments, the polymer component comprises carboxylate functional polymer or a modified carboxylate functional polymer. In certain embodiments, the polymer component comprises a polyacrylic acid (PAA) and/or an acrylic/maleic copolymer. In one embodiment, the polymer component comprises PAA. Other examples of suitable polymers included polyacrylates having a molecular weight of from about 1,000 to about 400,000 and polymers based on acrylic acid combined with other moieties. These include acrylic acid combined with maleic acid; methacrylic acid; phosphonate; maleic acid and vinyl acetate; acrylamide; sulfophenol methallyl ether; 2-acrylamido-2-methylpropane sulfonic acid; 2-acrylamido-2-methylpropane sulfonic acid and sodium styrene sulfonate; methyl methacrylate, sodium methallyl sulfonate and sulfophenol methallyl ether; polymaleates; polymethacrylates; polyaspartates; ethylenediamine disuccinate; organo polyphosphonic acids and their salts. Examples of suitable polymeric components are commercially available from BASF Corporation under the trade name SOKALAN®, such as SOKALAN® CP 5, SOKALAN® CP 42, SOKALAN® CP 50, SOKALAN® PA 25 CL, and PA SOKALAN® PA 30 CL, SOKALAN® CP 10 S, SOKALAN® CP 12 S, and SOKALAN® 13 S. "CP" generally designates a copolymer whereas "PA" generally designates a polyacrylate.

If utilized, the antiscalant component can be used in various amounts. In certain embodiments, the antiscalant component is present in the cleaning composition in an amount of from about 0.05 to about 10, about 0.1 to about 5, or about 0.2 to about 2, wt. %, each based on 100 parts by weight of the cleaning composition, or any range between the lowest and highest of these values.

Optionally, the cleaning composition may include one or more additives. Any type of additive can be utilized, especially additives which are conventionally used in ADW applications. Examples of suitable additives include water, supplemental builder components such as metal citrates, bleaches, enzymes, solvents, salts, soil release polymers, foam inhibitors, complexing agents, fragrances, fillers, inorganic extenders, formulation auxiliaries, solubility improvers, dyes, corrosion inhibitors, peroxide stabilizers, electrolytes, soaps, detergents, solvents such as ethylene glycol, 2-butoxyethanol, butyldiglycol, alkyl glycol ethers, and isopropanol, perfumes, oils, oxidizing agents such as perborates, dichloroisocyanurates, interface-active ethyleneoxy adducts, and combinations thereof.

In various embodiments, the cleaning composition further comprises water. The water can be of various types. In certain embodiments, the water is demineralized. The water is present in the composition in various amounts, depending on the embodiment. The water can be added to the composition as a separate component. However, some of the water can also be imparted by one of the other components, such as by the chelating component and/or acidic component when aqueous as alluded to above.

In certain embodiments, water is present in the remaining amount of parts by weight of the cleaning composition including the reaction product, the surfactant component, and optionally, the hydrotrope and/or other additive component(s). In embodiments where the cleaning composition is a liquid, water is typically present in the cleaning composition in an amount of from about 30 to about 99, about 30 to about 40, or about 80 to about 90, wt. %, each based on 100 parts by weight of the cleaning composition, or any range between the lowest and highest of these values. The amount of water can be adjusted based on the desired form of the composition. As such, the present invention is not limited to a particular amount of water. For example, the cleaning composition can be formulated as a "low", "medium", or "high" actives composition with decreasing amounts of water, respectively, where the actives comprise at least the reaction product and surfactant component of the cleaning composition.

In certain embodiments, the cleaning composition is substantially free of phosphorus-containing compounds, making the cleaning composition more environmentally acceptable. Phosphorus-free refers to a composition, mixture, or ingredients to which phosphorus-containing compounds are not added. Should phosphorus-containing compounds be present through contamination of a phosphorus-free composition, mixture, or ingredient, the level of phosphorus-containing compounds in the resulting cleaning composition is typically less than about 0.5, less than about 0.1, or less than about 0.01, wt %, each based on 100 parts by weight of the cleaning composition, or any range between the lowest and highest of these values. In various embodiments, the cleaning composition is free of phosphorus-containing compounds.

In various embodiments, the cleaning composition is free of a chlorine-containing component. Examples of components containing chlorine include chlorine bleaches, which generally belong to a group of strong oxidizing agents, all of which have one or more chlorine atoms in their molecule. Specific examples of chlorine bleaches used in the art include chlorinated isocyanurates, chlorinated trisodium phosphate, hypochlorite, and sodium hypochlorite. By free of a chlorine-containing component, it is generally meant that the cleaning composition is free of a purposefully added component including chlorine, such as the addition of chlorine bleach, e.g. sodium hypochlorite. In some embodiments, the cleaning composition includes some trace amount of chlorine, such as a trace amount of chlorine present in one or more of the components.

In various embodiments, the cleaning composition includes chlorine in an amount of from about 0.50 to approaching zero (0), about 0.25 to approaching 0, or about 0.10 to approaching 0, wt %, each based on 100 parts by weight of the cleaning composition, or any range between the lowest and highest of these values. In certain embodiments, the cleaning composition completely excludes chlorine.

In various embodiments, the cleaning composition is free of a bleach component. While chlorine bleaches tend to be commonly used bleach components, other bleaches include non-chlorine bleaches, such as peroxygen compounds, which release active oxygen in wash water. Further examples of non-chlorine bleaches include perborates/sodium perborates, potassium monopersulfates, sodium percarbonates, hydrogen peroxides, and organic peracids. In various embodiments, the cleaning composition includes the bleach component in an amount of from about 15 to approaching zero (0), about 10 to approaching 0, about 5.0 to approaching 0, or about 1.0 to approaching 0, wt %, each based on 100 parts by weight of the cleaning composition, or any range between the lowest and highest of these values. In certain embodiments, the cleaning composition completely excludes the bleach component.

The cleaning composition can be formed by various methods. Typically, the cleaning composition is formed by simply combining, e.g. mixing, all of the components together. In certain embodiments, the reaction product is formed separately by first combining the chelating component and the acidic component. The surfactant component and other components, if utilized, are then combined with reaction product to form the cleaning composition. Alternatively, all of the components can be combined together and the reaction product can be formed in sutu. The cleaning composition is not limited to any particular method of manufacture.

The following examples, illustrating the cleaning compositions of the present invention, are intended to illustrate and not to limit the invention.

EXAMPLES

Various formulations of the cleaning composition are prepared. The cleaning compositions are prepared by first adding the acidic component to the chelating component (if applicable) while stirring to form each of the reaction products. The reaction products are then combined with the other components and mixed to form the cleaning compositions. The pH and compatibility index, i.e., cloud point, is measured for each of the formulations.

Example 1 below is a comparative example and Examples 2-4 are invention examples. The cleaning compositions are used to clean dishware, flatware, and/or glassware utilizing simulated test methods and/or automatic dishwashing (ADW) machines. Conventional dishwasher times, temperatures, and amounts of water are utilized. For example, conventional dishwashers generally have wash and rinse cycles that last from about 30 to about 150 minutes, have washing temperatures of from about 100° F. to about 150° F., and each cycle uses about 1 to about 5 liters of water. After washing, the wares are visually evaluated for spotting and filming and each of the examples are ranked for performance. Evaluation of spotting and filming can also be done in parallel or separately with a digital image analysis tool (DIAT), which measures light transmittance and reflectance.

All values in Table I below are in wt % based on 100 parts by weight of the respective cleaning composition. The amounts illustrated for each of the components is "as is". For example, 2.5 wt. % of the hydrotrope component imparts 1 wt. % hydrotrope actives to each of the formulations, while 30 wt. % of the surfactant component imparts 30 wt. % surfactant actives to each of the formulations. "RT" is room temperature (i.e., ~23° C.), and "dI" is de-ionized.

TABLE I

| | | Example | | | |
|---|---|---|---|---|---|
| Component | Actives wt. % | 1 | 2 | 3 | 4 |
| Surfactant | 100 | 30 | 30 | 30 | 30 |
| Hydrotrope | 40 | 2.5 | 2.5 | 2.5 | 2.5 |
| Acidic | 10 | 10 | 0 | 0 | 0 |
| Rxn Prod. 1 | 45.05 | 0 | 3.18 | 0 | 0 |
| Rxn Prod. 2 | 48.65 | 0 | 0 | 2.97 | 0 |
| Rxn Prod. 3 | 42.76 | 0 | 0 | 0 | 3.33 |
| dI Water | 100 | 57.5 | 64.32 | 64.53 | 64.17 |
| Total | | 100 | 100 | 100 | 100 |
| pH | | 2.56 | 9.21 | 2.74 | 10.1 |
| Compatibility Index (° F.) | | >RT | ~RT | >RT | RT |

Surfactant is a nonionic surfactant, specifically a monofunctional, linear alcohol alkoxylate, having an average molecular weight of 820, a pH of from 5 to 6.5 (1% aq.) a viscosity of 80 cps at 25° C., an HLB of 7, and a cloud point of from 22 to 27° C. (1% aq.), commercially available from BASF Corporation.

Hydrotrope is sodium xylenesulfonate (SXS).

Acidic is citric acid.

Rxn Prod. 1 is the reaction product of 1:1 MGDA:MSA.

Rxn Prod. 2 is the reaction product of 1:2 MGDA:MSA.

Rxn Prod. 3 is the reaction product of 2:1 MGDA:MSA.

The chelating component (MGDA) used to form the reaction products is a liquid, 40% actives, commercially available from BASF Corporation.

The acidic component (MSA) used to form the reaction products is a liquid, 70% actives, commercially available from BASF Corporation.

Examples 2-4 provide equivalent or better performance than Example 1. Example 2 is deemed the best overall performer, yielding superior performance over Example 1 based on visual inspection of the wares after washing. The invention compositions also provide excellent cost performance, e.g. less amount required, and increased stability relative to conventional compositions. The invention compositions are also useful for removing and/or preventing scale in the dishwasher itself.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and or in combination and provides adequate support for specific embodiments within the scope of the appended claims.

It is also to be understood that any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The present invention has been described herein in an illustrative manner, and it is to be understood that the terminology which has been used is intended to be in the nature of words of description rather than of limitation. Many modifications and variations of the present invention are possible in light of the above teachings. The present invention may be practiced otherwise than as specifically described within the scope of the appended claims. The subject matter of all combinations of independent and dependent claims, both single and multiple dependent, is herein expressly contemplated.

What is claimed is:

1. A cleaning composition for dishwashing, said cleaning composition comprising:

(I) from 1 to 2 wt. % of the reaction product of;

A) a chelating component comprising methylglycine-N—N-diacetic acid (MGDA) and/or a salt thereof, and B) an acidic component comprising methanesulfonic acid (MSA), wherein said B) acidic component and A) said chelating component are reacted in a molar ratio (B:A) of from about 1:1 to about 3:1 to form the reaction product;

(II) from about 10 to about 40 wt. % of a surfactant component comprising a nonionic surfactant that is a monofunctional, linear alcohol alkoxylate; and (III) from about 0.1 to about 5 wt. % a hydrotrope component that is sodium xylenesulfonate; and (IV) optionally, water, wherein said cleaning composition is free of unreacted MGDA and MSA.

2. The cleaning composition of claim 1 wherein said surfactant component is present in an amount of from 20 to 30 wt. %.

3. The cleaning composition of claim 1 further comprising a dispersant and/or antiscalent.

4. The cleaning composition of claim 3 wherein the dispersant and/or antiscalant comprises a carboxylate functional polymer, a modified carboxylate functional polymer, a polyacrylic acid (PAA), and/or an acrylic/maleic copolymer.

5. The cleaning composition of claim 3 wherein the dispersant and/or antiscalant comprises a polyacrylate having a molecular weight of from about 1,000 to about 400,000 g/mol.

6. The cleaning composition of claim 1 further comprising an antiscalant present in an amount of from 0.05 to 10 wt. % based on 100 parts by weight of said cleaning composition.

7. The cleaning composition of claim 1 wherein said water is present.

8. The cleaning composition of claim 7 wherein said water is present in an amount from 30 to 40 wt. % based on 100 parts by weight of said cleaning composition.

9. The cleaning composition of claim 1 that comprises less than 0.5 wt % of phosphorous-containing compounds based on 100 parts by weight of said cleaning composition.

10. The cleaning composition of claim 1 that is free of a chlorine-containing component.

11. The cleaning composition of claim 1 that further comprises chlorine in an amount of less than 0.50 wt % based on 100 parts by weight of said cleaning composition.

12. The cleaning composition of claim 1 that further comprises a bleach component in an amount of less than 15 wt % based on 100 parts by weight of said cleaning composition.

* * * * *